US010718043B2

(12) United States Patent
Mitsuda et al.

(10) Patent No.: US 10,718,043 B2
(45) Date of Patent: Jul. 21, 2020

(54) TITANIUM PLATE

(71) Applicant: NIPPON STEEL & SUMITOMO METAL CORPORATION, Tokyo (JP)

(72) Inventors: Koji Mitsuda, Tokyo (JP); Kazuhiro Takahashi, Tokyo (JP); Joe Ito, Tokyo (JP); Hideto Seto, Tokyo (JP); Hidenori Takebe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 74 days.

(21) Appl. No.: 16/069,250

(22) PCT Filed: Jan. 18, 2016

(86) PCT No.: PCT/JP2016/051320
§ 371 (c)(1),
(2) Date: Jul. 11, 2018

(87) PCT Pub. No.: WO2017/126017
PCT Pub. Date: Jul. 27, 2017

(65) Prior Publication Data

US 2019/0032182 A1 Jan. 31, 2019

(51) Int. Cl.

| | |
|---|---|
| ***C22C 14/00*** | (2006.01) |
| ***C22F 1/18*** | (2006.01) |
| ***B21B 3/00*** | (2006.01) |
| ***C22F 1/00*** | (2006.01) |
| ***B21B 1/22*** | (2006.01) |
| ***C23G 1/10*** | (2006.01) |
| ***C23G 1/12*** | (2006.01) |

(52) U.S. Cl.
CPC ..... *C22F 1/183* (2013.01); *B21B 1/22* (2013.01); *B21B 3/00* (2013.01); *C22C 14/00* (2013.01); *C22F 1/00* (2013.01); *C22F 1/18* (2013.01); *C23G 1/10* (2013.01); *C23G 1/12* (2013.01)

(58) Field of Classification Search
CPC ..... C22F 1/183; C22C 14/00
See application file for complete search history.

(56) References Cited

U.S. PATENT DOCUMENTS

2004/0035503 A1* 2/2004 Fujii ..... C22C 14/00 148/421
2015/0280251 A1* 10/2015 Takahashi ..... C23C 8/10 429/509

FOREIGN PATENT DOCUMENTS

| | | |
|---|---|---|
| CN | 102470407 | 5/2012 |
| CN | 103608487 | 2/2014 |
| JP | 60-238465 | 11/1985 |
| JP | 2002-003968 | 1/2002 |
| JP | 2002-194591 | 7/2002 |
| JP | 2005-298930 | 10/2005 |
| JP | 2010-255085 | 11/2010 |
| JP | 2011-020135 | 2/2011 |
| JP | 2011-208244 | 10/2011 |
| JP | 2013-010115 | 1/2013 |
| KR | 10-1522799 | 5/2015 |

* cited by examiner

*Primary Examiner* — Jessee R Roe
(74) *Attorney, Agent, or Firm* — Clark & Brody LP

(57) ABSTRACT

A titanium plate is provided in which a Vickers hardness $Hv_{0.025}$ at a load of 0.245 N at a surface is 150 or less, and an average length of the profile elements RSm is 80 μm or less and a maximum height Rz is less than 1.5 μm, RSm and Rz being as defined in JIS B 0601: 2013. The titanium plate has good surface deformability.

2 Claims, 2 Drawing Sheets

TITANIUM PLATE

TECHNICAL FIELD

The present invention relates to a titanium plate.

BACKGROUND ART

Because of their excellent corrosion resistance, titanium plates are used as the starting material for heat exchangers in various plants such as chemical plants, power plants and food processing plants. For a plate-type heat exchanger, among others, it is intended to raise the heat exchanging efficiency by increasing the surface area of a titanium sheet by forming recesses and protrusions in the sheet by press forming, which requires excellent formability.

Patent Document 1 discloses a technique including: forming an oxide film and a nitride film by heating in an oxidizing atmosphere or a nitriding atmosphere; thereafter performing bending or pulling out to introduce fine cracks into these films and to expose the titanium metal; and thereafter scarfing in an acid aqueous solution in which titanium metal is soluble to form dense and deep irregularities. Patent Document 1 discloses that the oil retainability of a lubricating oil increases and the lubricity improves, and that by causing an oxide film and a nitride film to remain on the surface or by the formation thereof, the lubricity further improves.

Patent Document 2 discloses that, by performing pickling and skin pass rolling after atmospheric annealing to thereby make a surface roughness Ra, a maximum height Rz and a degree of strain (Rsk) fall within a specific numerical value range, oil retainability can be exerted and the inducement of cracks caused by the notch effect can be prevented, and the formability improves. Further, by making the Vickers hardness at a measurement load of 0.098 N at the surface higher than a Vickers hardness at a measurement load of 4.9 N and making the difference therebetween not more than 45, the occurrence of surface cracks during forming is prevented.

Patent Document 3 discloses a titanium plate in which the arithmetic average roughness of the surface in a direction parallel to the rolling direction is not less than 0.25 μm and not more than 2.5 μm, and the Vickers hardness at a test load of 0.098 N at the surface is 20 or more higher than the Vickers hardness at a test load of 4.9 N, and the Vickers hardness at the test load of 4.9 N is not more than 180. The Patent Document 3 discloses that, by making the roughness of the surface of the titanium plate coarse to a certain extent, the amount of lubricant that is drawn-in between the titanium plate and the forming press tooling during press forming is increased, and the formability improves.

Patent Document 4 discloses that, by chemically or mechanically removing a region of 0.2 μm from the surface, the surface hardness at a load of 200 gf (1.96 N) is made 170 or less and the thickness of an oxide film is made 150 Å or more by eliminating, during cold working, residual oil which was scored into the surface and thereafter performing vacuum annealing. The Patent Document 4 discloses that, by this means, without impairing the formability of the starting material, the lubricity with respect to the die and tooling during forming is maintained, and the formability improves.

LIST OF PRIOR ART DOCUMENTS

Patent Documents

Patent Document 1: JP2005-298930A
Patent Document 2: JP2010-255085A

Patent Document 3: JP2002-003968A
Patent Document 4: JP2002-194591A

SUMMARY OF INVENTION

Technical Problem

There is no description regarding formability in Patent Document 1. Further, if an oxide film or a nitride film is formed prior to pickling for obtaining a specific surface profile as in the technique described in Patent Document 1, although the lubricity improves, the films serve as the starting point of cracks during bulge forming or the like, and conversely there is a possibility that the films will be a factor that decreases the formability.

Patent Document 2 discloses that the surface profile is adjusted by pickling and skin pass rolling, to thereby improve the formability. However, since the technique described in Patent Document 2 is a method in which protrusions of the irregularities formed by pickling after annealing are smoothed by skin pass rolling, it is difficult to control the shape of the recesses, in particular in a case where there are large recesses, there is a possibility that the recesses will serve as the starting points for stress concentration and will induce cracking. Further, the method must include a process of atmospheric annealing, and must remove a region of approximately 10 μm or more from a surface on a single side to make a difference between the hardness of the surface and the hardness of the base metal not more than 45, and this leads to a deterioration in the yield rate.

According to the technique disclosed in Patent Document 3, only the surface roughness Ra is controlled, and absolute values of the sizes of irregularities cannot be defined, and there is a possibility that formability will decrease due to the notch effect in a case where large irregularities exist locally.

The techniques disclosed in Patent Documents 1 to 3 are each directed towards raising the oil retainability of a lubricant, and absolutely no consideration is given to the formability of the material itself. On the other hand, Patent Document 4 does contain some reference regarding improving the formability of the material itself.

Specifically, Patent Document 4 discloses that the surface hardness ($Hv_{0.2}$) can be lowered by a surface treatment after cold working, and by this means the formability of the starting material is improved. Nevertheless, absolutely no consideration is given to the surface profile thereof, and there is also no description whatsoever regarding the influence that the surface profile has on formability. Further, because the surface hardness measurement is a measurement at a comparatively large load of 200 gf (1.96 N), there is a possibility that information regarding the outermost layer of the titanium plate has not been obtained.

An objective of the present invention, which has been made to solve such problems of the prior art, is to provide a titanium plate that, by improving the surface profile that is a cause of the notch effect and suppressing the formation of a brittle hardened layer at an outer layer, has favorable surface deformability.

Solution to Problem

In the case of a pure titanium plate, C and N that are mixed in during the process of melting the titanium form hard compounds (TiC or TiN), and the hard compounds present in the outer layer of the titanium plate become starting points for cracks during working. Research has already been conducted regarding metallurgical factors such as the metal micro-structure (grain diameter) and the chemical composition with a view to preventing such cracks. Further, the conditions and oil retainability of lubricants and the like have also been investigated. However, there are no examples of research conducted with respect to the surface deformability of a titanium plate itself. Therefore, using specimens in which the chemical composition and metal micro-structure (grain diameter) were of the same level, the present inventors investigated, in particular, the influence that surface profile and surface hardness have on formability.

First, the comparatively simple and easy Erichsen test is generally used as a method for evaluating the formability of a plate material. The Erichsen test is usually performed using a solid or liquid lubricating oil as a lubricant, and many examples exist in which evaluation is performed under such lubrication conditions. However, in a test that is performed on the premise of the use of a lubricant, the measurement values will vary significantly depending on the influence of the performance and oil retainability and the like of the lubricant, and hence such a test is not appropriate for evaluating the surface deformability of a starting material itself. Further, during cold rolling, a carbon component is included in the lubricant and if the carbon component is scored into the titanium plate surface and remains therein, hard TiC will form in the surface.

Therefore, in order to evaluate the surface deformability of the starting material itself, the present inventors evaluated a titanium plate by means of an Erichsen test conducted under an extremely high lubrication condition (hereunder, referred to as "high-lubrication Erichsen test") in which a PTFE (polytetrafluoroethylene) sheet in which surface deformability noticeably appears was adopted as a lubricant. In this case, a coefficient of friction μ of the PTFE sheet used in the high-lubrication Erichsen test was approximately 0.04, which is extremely small in comparison to a coefficient of friction of approximately 0.4 to 0.5 between titanium and a testing tool when using a lubricating oil, and thus the influence of the lubrication between the starting material and the testing machine can be ignored. Therefore, it is possible to evaluate the surface deformability of the starting material itself.

On the other hand, to accurately obtain information regarding the hardness of an outermost layer of the titanium plate, the present inventors attempted to measure the Vickers hardness of the surface (hereunder, referred to as "$Hv_{0.025}$") under a very low load, specifically, a load of 25 gf (0.245 N). In the case the aforementioned low load, because the depth to which the Vickers indenter is pushed in is a shallow depth, the hardness of the outermost layer of the titanium plate can be evaluated. Note that, the indenter depth at 25 gf (0.245 N) that was calculated back from the result for the surface hardness was approximately 2 to 3 μm.

The relation between $Hv_{0.025}$ and the high-lubrication Erichsen test value is illustrated in FIG. 1. As illustrated in FIG. 1, by making $Hv_{0.025}$ a value of 150 or less, the high-lubrication Erichsen test value can be made to fall within a favorable range of 14.0 mm or more, while on the other hand, when $HV_{0.025}$ is more than 150, the high-lubrication Erichsen test value decreases, and when $Hv_{0.025}$ is more than 200 the high-lubrication Erichsen test value deteriorates to less than 14.0 mm. Accordingly, as a general tendency, it was found that the lower the surface hardness is, the greater the degree to which the formability improves, and specifically it was found that it is important to make $Hv_{0.025}$ 150 or less. However, in the range in which the surface hardness $Hv_{0.025}$ is 150 or less, differences were observed in the high-lubrication Erichsen test values even when the relevant hardnesses were of the same level, thus revealing that other factors apart from the surface hardness influenced the high-lubrication Erichsen test values.

As the result of concentrated studies regarding the aforementioned other factors, the present inventors ascertained that the average length of the profile elements RSm (see HS B 0601: 2013; hereunder also referred to as "mean spacing of irregularities") and a maximum height of the profile Rz significantly influence the surface deformability of the starting material itself. The relation between the high-lubrication Erichsen test value and the mean spacing of irregularities RSm and maximum height of the profile Rz is illustrated in FIG. 2. As illustrated in FIG. 2, variations in the high-lubrication Erichsen test values that were not clarified by way of the surface hardness could be suitably clarified using the mean spacing of irregularities RSm and the maximum height of the profile Rz, and in particular it was found that it is important to make the mean spacing of irregularities RSm 80 μm or less and to make Rz 1.5 μm or less.

The present inventors also conducted concentrated studies regarding a production method for obtaining a state having the aforementioned surface hardness and irregularities. Usually, a titanium plate is produced by a method that includes a melting process, a hot rolling process, a cold rolling process and an annealing process. Further, a degreasing process (alkali washing process) is generally included between the cold rolling process and the annealing process. The available types of annealing processes include a process that utilizes a batch-type BAF (box annealing furnace) method, a process that utilizes a continuous annealing and pickling line AP (annealing & pickling), and a process that utilizes a continuous bright annealing line BA (bright annealing). The BAF method is performed in a vacuum or a non-oxidizing atmosphere, and the BA method is performed in a non-oxidizing atmosphere. Therefore, a characteristic of these methods is that the surface profile after annealing can retain a surface state that is equivalent to the surface state before annealing (rolled surface), and descaling is not required. The AP method is a method that performs annealing on a equipment on which pickling and descaling are performed after annealing in a combustion gas atmosphere, and is used for intermediate annealing and for finishing annealing of products with a relatively thick plate thickness. In contrast, annealing by the BAF method or AP method is used for intermediate annealing and finishing annealing of an ultrathin plate. In addition, a BA line is also utilized as means for improving functionality, such as for grain diameter control, stress-relief heat treatment, and a surface nitriding treatment.

In the aforementioned degreasing process, although a lubricant utilized during the cold rolling process can be removed and the formation of scale during annealing can be suppressed, a hardened layer such as a layer containing TiC at the outer layer of the titanium plate cannot be completely removed. On the other hand, if pickling is performed after annealing, the removal of not only scale formed during annealing, but also of a hardened layer such as a layer containing TiC or TIN that concentrated at the outer layer can be performed.

The present invention has been made based on the above findings, and the gist of the present invention is a titanium plate described hereunder.

(1) A titanium plate in which a Vickers hardness $Hv_{0.025}$ at a load of 0.245 N at a surface is 150 or less, and an average length of profile elements RSm is 80 μm or less and a maximum height Rz is less than 1.5 μm, RSm and Rz being as defined in JIS B 0601: 2013.

(2) The titanium plate according to (1) above, in which, when a carbon concentration at a depth of 5 μm from the surface is represented by "Cs", and a carbon concentration at a depth of 20 μm from the surface is represented by "Cb", Cs/Cb is in a range of values less than 2.0.

Advantageous Effects of Invention

According to the present invention, since the surface profile that is a cause of the notch effect can be improved and the formation of a brittle hardened layer at an outer layer can be suppressed, a titanium plate having good surface deformability can be provided. Because the titanium plate is excellent in formability, the titanium plate is particularly useful as a starting material for a heat exchanger in, for example, a chemical plant, a power plant or a food processing plant.

DESCRIPTION OF EMBODIMENTS

Figure 1:
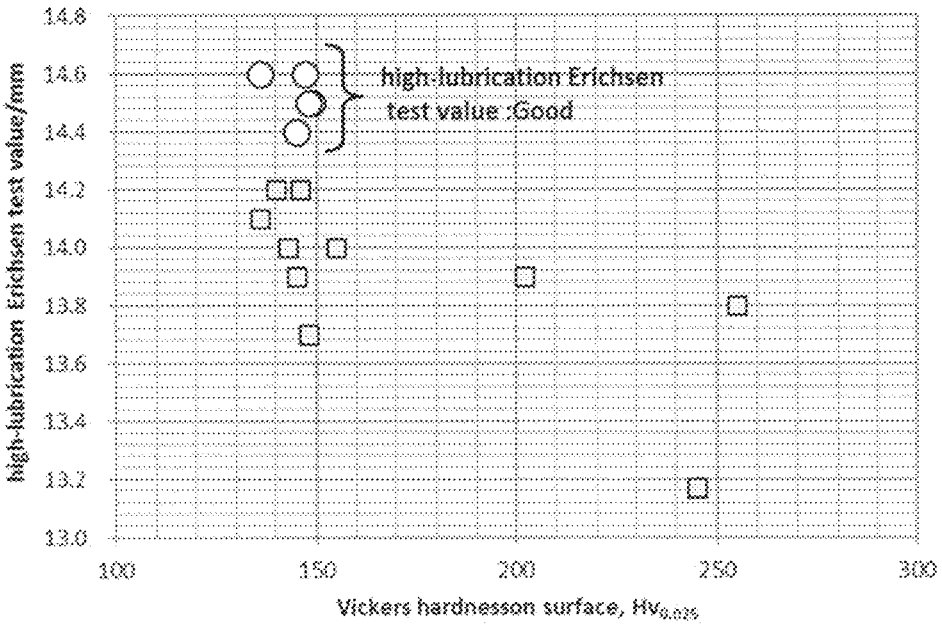
FIG. 1 is a view illustrating the relation between $Hv_{0.025}$ and a high-lubrication Erichsen test value.
Figure 2:
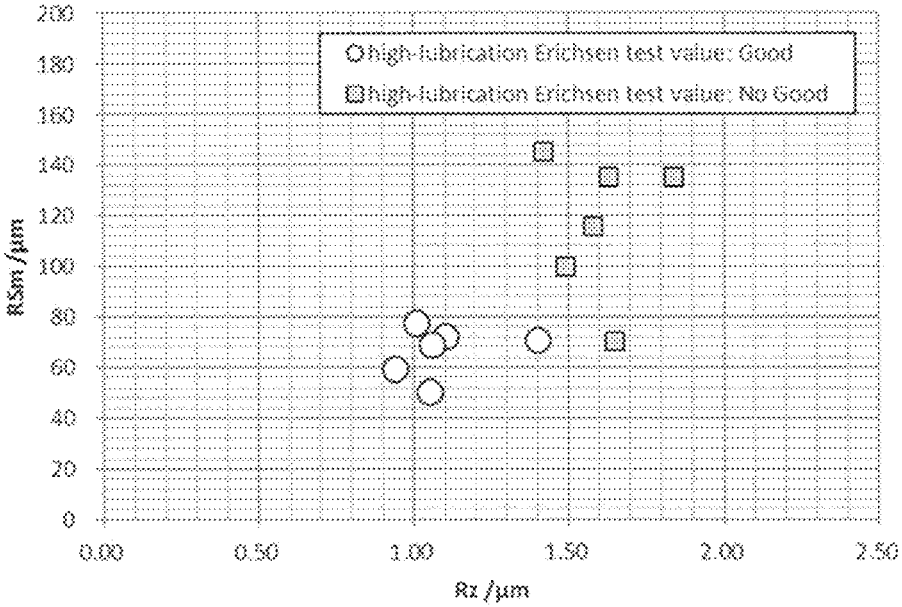
FIG. 2 is a view illustrating the relation between mean spacing of irregularities RSm and a maximum height of irregularities Rz in a case where $Hv_{0.025}$ is 150 or less.

An embodiment of the present invention is described hereunder.

1. Titanium Plate

Vickers Hardness $Hv_{0.025}$: 150 or Less

As described above, C and N or the like concentrate in an outer layer of a titanium plate during a hot rolling process, an annealing process or the like and compounds such as TiC and TiN are formed. Because such compounds are hard, they serve as the starting points of cracks during working. Therefore, in order to evaluate the formability of a titanium plate, it is important to know the hardness of a topmost layer. According to the prior art (for example, Patent Document 4), because the Vickers hardness ($Hv_{0.2}$) is measured at a relatively large load of 200 gf (1.96 N), and the measurement is also affected by the hardness of the bulk of the titanium plate, the hardness of the outer layer which significantly influences the formability of the titanium plate cannot be accurately known. Therefore, the present inventors focused attention on the Vickers hardness ($Hv_{0.025}$) under a load of 25 gf (0.245 N). This is because, in the case of a low load of this kind, the depth to which the Vickers indenter is pushed in is shallow (around 2 to 3 μm), and the hardness of only the outer layer of the titanium plate can be evaluated.

Further, in a case where the Vickers hardness ($Hv_{0.025}$) under this load of 25 gf (0.245 N) is more than 150, a high-lubrication Erichsen test value decreases. Therefore, the Vickers hardness ($Hv_{0.025}$) is made 150 or less. The Vickers hardness ($Hv_{0.025}$) is preferably made 145 or less, and more preferably is made 140 or less. However, even if the Vickers hardness ($Hv_{0.025}$) is low, the high-lubrication Erichsen test value may sometimes become somewhat lower. This is due to the influence of the surface that is described later.

Average Length of Profile Elements RSm: 80 μm or Less

When the Vickers hardness ($Hv_{0.025}$) is made 150 or less, although the high-lubrication Erichsen test value can be made 14.0 or more, there are differences in high-lubrication Erichsen test values that are obtained even when the hardness is the same. Therefore, the surface profile of the titanium plate is important for improving the formability of a titanium plate, that is, for improving the surface deformability of the starting material itself. Although in the prior art the value for Ra or Rz is controlled, this is determined from the viewpoint of oil retainability, and is unrelated to an evaluation by means of a test method which is not affected by oil retainability, such as the high-lubrication Erichsen test. On the other hand, the average length of the profile elements RSm (see JIS B 0601: 2013) means the mean spacing of irregularities of a titanium plate surface, and if the RSm value is made 80 μm or less, the high-lubrication Erichsen test values can be stably made high values. The RSm value is preferably made 75 μm or less, and more preferably is made 70 μm or less.

When the RSm value is made a small value, the number of irregularities increases. Consequently, the starting points for stress concentration increase. However, since work hardening occurs at stress concentration parts unless the stress concentration factors of the respective irregularities are too large, even if cracks arise, the cracks do not propagate and breakage does not occur. In a case where breakage does not occur, it is considered that the more stress concentration parts that exist, the greater the degree to which localized deformations are suppressed and the workability is improved. In general, although deformations arise in grain units, stress concentration starting points can be dispersed by causing a large number of irregularities to be formed on the surface, and the workability is improved when the RSm value corresponding to the mean spacing of irregularities is 80 μm or less. However, it is considered that in a case where there are no irregularity, grains in which stress is concentrated arise due to the influence of the orientation of the grains, and such stress is liable to shift to localized deformations and lead to breakage, and therefore it is desirable to make the RSm value 10 μm or more.

Maximum Height of Profile Rz: Less than 1.5 μm

In the case of increasing stress concentration starting points by decreasing the RSm, it is necessary to lower the stress concentration factor of the starting points. That is, it is considered that the stress concentration factor increases when Rz is large, and an effect that reduces the RSm value decreases. Therefore, in addition to the RSm value, by controlling the maximum height of profile Rz to be less than 1.5 μm, the outer layer of the titanium plate of the present invention can adequately exert the formability of a titanium product. A preferable range of Rz is 1.3 μm or less. However, because Rz cannot be made smaller than Ra, based on past records of production performance it is considered that if the value thereof is 0.1 μm or more, production can be performed in a manner that suppresses an increase in cost.

In this case, when the carbon concentration at a depth of 5 μm from the surface is represented by Cs (outer layer carbon concentration), and the carbon concentration at a depth of 20 μm is represented by Cb (bulk carbon concentration), it is preferable that Cs/Cb is made to fall within a range of values less than 2.0. As described above, this is because if C concentrates in the outer layer of the titanium plate and hard TiC is formed, the TiC becomes a starting point for cracks during working.

Pure titanium can be used as the material constituting the titanium plate of the present invention. However, it is necessary to adopt a chemical composition such that the Vickers hardness is 150 or less in a case where there is no hardened layer also. The most important element is oxygen, and it is good to make the content thereof 0.12% or less in percent by mass. A Vickers hardness of 150 or less cannot be achieved if the content of nitrogen and carbon is excessive, and therefore it is good to make the content of each 0.06% or less in percent by mass. Iron is excessively refined if the content thereof is excessive, and therefore it is good to make the content thereof 0.15% or less in percent by mass. Further, these elements are unavoidable impurities, and each of these elements is normally contained in an amount of 0.0001% or more in percent by mass.

2. Method of Producing Titanium Plate

As described above, removal of a hard layer, such as a layer containing TiC, that is formed on the surface of a titanium plate is achieved by performing pickling after a cold rolling process, or by performing pickling after annealing. However, it is difficult to adjust the state of irregularities on the titanium plate surface to be within a desired range through pickling alone. Therefore, it is good to perform rolling with a work roll adjusted to a desired surface roughness in the final pass or final two passes of cold rolling. That is, by performing rolling with a work roll whose surface is adjusted in the final pass or final two passes in the cold rolling process and performing nitric-hydrofluoric acid pickling, and thereafter performing the annealing in a non-oxidizing atmosphere, the average length of the profile elements RSm on the titanium plate surface can be made 80 μm or less, and Rz can be made less than 1.5 μm. Further, as a different production method, by performing pickling after annealing and then performing rolling with a temper rolling roll that is adjusted to a desired surface roughness, the average length of the profile elements RSm on the titanium plate surface can be made 80 μm or less, and Rz can be made less than 1.5 μm. In the case of removing a hard layer of TiC or the like from the titanium plate surface in a pickling process after annealing, when adopting the BAF annealing method, elements such as C and N on the surface diffuse toward the interior of the titanium plate, and therefore a large amount of pickling is necessary. However, when adopting a continuous annealing method, because the annealing time period is short, a diffused layer of elements such as C and N is shallow compared to when the BAF method is used, and therefore it is possible to remove the hard layer with a light amount of pickling.

In a nitric-hydrofluoric acid pickling process, in order to completely remove TiC and the like that is present on the surface, for example, it is good to make the pickled and scarfed amount per side between 2 to 4 μm. Further, it is good to perform pickling using a nitric-hydrofluoric acid solution obtained by mixing, for example, nitric acid: 40 to 50 g/l and hydrofluoric acid: 20 to 30 g/l, and immersing for 10 secs or more in the acid solution at 50 to 60° C.

In order to provide desired irregularities on the surface of a titanium plate, it is important to perform the final pass or final two passes of cold rolling with a work roll having a surface state that is close to the state of the irregularities which is desired to provide on the titanium plate surface. By this means, it is possible to make the average length of the profile elements RSm on the titanium plate surface 80 μm or less and to make Rz less than 1.5 μm. The common rolling equipment used for titanium is a reverse rolling mill. When using the rolling mill, multiple passes of cold rolling are performed using the same work roll, and in accompaniment therewith the surface of the work roll exhibits a state in which the surface includes large irregularities due to adhesion of titanium and the like. If cold rolling is continued in that state it will be difficult to stably obtain a desired surface profile because irregularities will be transferred from the work roll and formed on the titanium plate surface. Hence, it is necessary to use a work roll whose surface has been adjusted in the final pass or final two passes of the cold rolling process. It is important that the work roll has such a roll surface that, on the titanium plate surface after cold rolling, the average length of the profile elements RSm is 80 μm or less and the maximum height Rz is less than 1.5 μm, RSm and Rz being as defined in B 0601: 2013. Because the surface profile of the roll surface will vary depending on the acid composition as well as the temperature of the pickling liquid and the pickling time period in the pickling process thereafter, it is necessary to determine a surface roll shape that is suited for the pickling conditions in advance. The surface of the work roll may be formed by simple polishing, or by laser machining, cutting, shot-blasting or the like.

As long as the surface profile of the titanium plate can be adjusted to fall within the range defined by the present application by performing cold rolling and a pickling process thereafter, a temper rolling process need not be performed. It is necessary to perform a temper rolling process in a case where the surface profile of the titanium plate is not adjusted during cold rolling. In such case, it is necessary for the surface of the temper rolling roll to adjust the surface of the titanium plate produced by the cold rolling process, nitric-hydrofluoric acid pickling process and annealing process so that, on the titanium plate surface when temper rolling is performed, the average length of the profile elements RSm is 80 μm or less and the maximum height Rz is less than 1.5 μm, RSm and Rz being as defined in JIS B 0601: 2013. Note that, in the case of performing temper rolling using a work roll having a controlled surface, there is no necessity to perform control of the work roll surface in the final pass or final two passes. This is because a desired surface profile can be imparted by the temper rolling. Similarly to the work roll used in the cold rolling process, the surface of the work roll for the temper rolling process may be formed by simple polishing, or by laser machining, cutting, shot-blasting or the like.

A degreasing process may also be provided after the cold rolling process. In particular, in a case where cold rolling is performed using a lubricant, the degreasing process is performed to remove the lubricant.

In the cold rolling process, there are no particular restrictions with respect to conditions other than the aforementioned conditions for the work roll, and the cold rolling process can be performed using the usual conditions. For example, it is good to perform the rolling reduction by cold working at a rate of 80 to 90% with a Sendzimir rolling mill, using a commercially pure titanium plate having a thickness of 4.5 mm that was descaled after hot rolling.

If the annealing process is performed in atmospheric air, it will be necessary to provide a descaling process after annealing, and there is thus the possibility of causing a deterioration in the yield. Therefore, in a case where the plate thickness is thin, it is advantageous to perform the annealing process in a non-oxidizing atmosphere. For example, annealing in an argon gas atmosphere or vacuum annealing is preferable. Note that, although a nitrogen gas atmosphere may also be used, if heat treatment is performed for an extended time period, there is the problem that a hardened layer in which nitrogen dissolved or that was nitrided is liable to be formed on the titanium plate surface. As the annealing conditions, for example, in a vacuum atmosphere in which the degree of vacuum is made $1.33\times10^{-3}$ Pa ($1.0\times10^{-5}$ Torr) or less, the titanium plate is held for 240 min after the temperature of the plate reaches 650 to 700° C., and thereafter the plate is subjected to furnace cooling while being kept in the vacuum atmosphere. This is done to adjust the grain diameters in the titanium plate to within grain diameter range of 50 to 100 μm (grain size number: on the order of 4 to 6) that is excellent in bulging formability. Further, to prevent overheating or non-uniform heating of the plate, it is good to perform heating at a rate of temperature increase of not more than 3.0° C./min. In a case where annealing is performed in a continuous system, it is preferable to make the annealing temperature 700 to 820° C. and to perform annealing for a holding time of 10 to 600 secs.

EXAMPLES

Titanium plates for test use were prepared under conditions shown in Table 1 using pure titanium of JIS grade 1 as specimens.

Note that, in the cold rolling process, the work roll was polished with Emery paper #120, and a descaled pure titanium plate having a descaled thickness of 4.5 mm was reduced (rolling reduction: approximately 89%) to a thickness of 0.5 mm. At this time, in the examples in which "-" is described in the column for "finishing roll control", cold rolling was performed using the same work roll until the final pass, while in the examples in which "Yes" is described in the column for "finishing roll control", the cold rolling in the final one pass was performed using a work roll for which RSm was 80 μm or less and Rz was less than 1.5 μm.

"Alkali washing" is a washing process performed in an aqueous solution that contains sodium hydroxide as a main component. Further, "nitric-hydrofluoric acid pickling" is a pickling process in which the titanium plate is immersed in a nitric-hydrofluoric acid (nitric acid: 50 g/l, hydrofluoric acid: 20 g/l, acid solution temperature: approximately 55 to 60° C.) to scarf from 1 to 21 μm per side and form a large number of minute irregularities, and also remove oil that was scored during cold rolling.

In the "annealing process", in the case where annealing was performed in a "vacuum", the rate of temperature increase was adjusted to a range of 2.5 to 2.7° C./min (heating-up period: approximately 180 min), and thereafter the titanium plate was furnace cooled while retaining the vacuum atmosphere. In the case of specimens for which the atmosphere was "Ar" or "atmospheric air", heating was performed by infrared heating at a rate of temperature increase of 20° C./s, and after being held at the annealing temperature, the relevant specimen was cooled in an Ar gas atmosphere or atmospheric air.

In the "temper rolling process", in the examples of Test Nos. 5, 6, and 8 to 13, temper rolling was performed using a work roll for which RSm was 80 μm or less and Rz was less than 1.5 μm.

Figure 3:
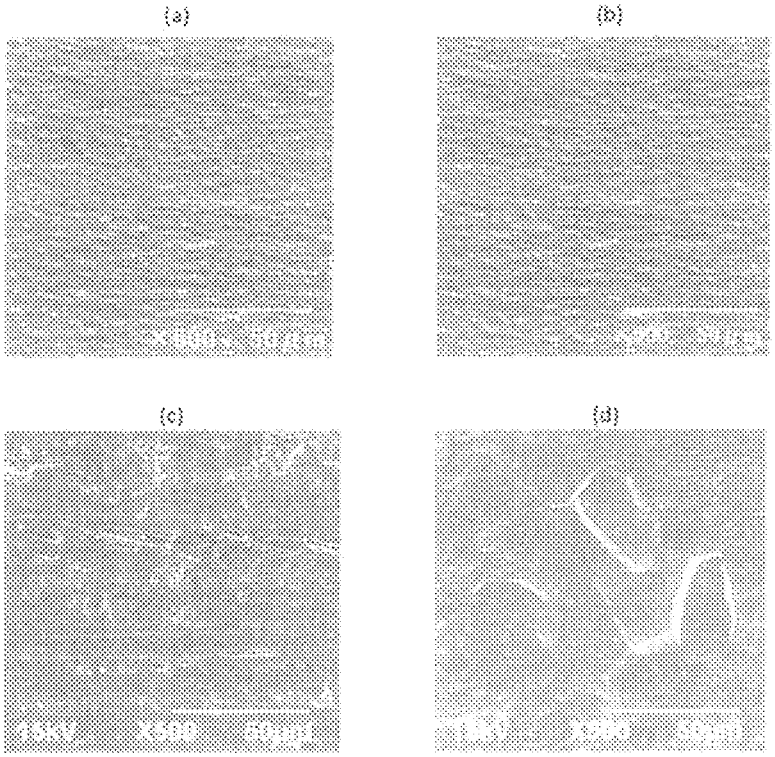
FIG. 3 is a view showing SEM images for Test Nos. 1, 3, 15 and 22, in which (a) shows an SEM image for Test No. 1, (b) shows an SEM image for Test No. 3, (c) shows an SEM image for Test No. 15, and (d) shows an SEM image for Test No. 22.

The obtained titanium plates for test use were subjected to measurement of the Vickers hardness at a load of 25 gf (0.245 N), the average length of the profile elements RSm and the maximum height of the profile Rz, RSm and Rz being based on defined in JIS B 0601: 2013. The surface hardness was measured at a load of 25 gf (0.245 N) with a micro-Vickers hardness testing machine. With respect to surface roughness, a measurement length of 4 mm in a direction parallel to the rolling direction was measured using a stylus type surface roughness measuring machine. In addition, a PTFE sheet having a thickness of 50 μm and a coefficient of friction μ of 0.04 was interposed between the sample under test and the testing machine, the Erichsen test was performed under conditions in which the sample under test and the testing machine did not directly contact, and a high-lubrication Erichsen test value was measured. Further, the amount of scarfing (amount of scarfing per side) produced by the nitric-hydrofluoric acid pickling was determined using a titanium density of 4.5 g/cm$^3$ based on the change in weight between before and after pickling. The results of these tests are shown together with the production conditions in Table 1. Further, FIG. 3 shows SEM images for Test Nos. 1, 3, 15 and 22.

TABLE 1

| | Cold Rolling Process | | Cleaning Process | Pickling Process | | | | Pickling Process | Rolling Reduction in Temper Rolling Process |
|---|---|---|---|---|---|---|---|---|---|
| | Cold-Rolling | | | Nitric- | Annealing Process | | | Nitric- | |
| No. | Rate (%) | Finishing Roll Control | Alkali Washing | Hydrofluoric Acid Pickling | Atmosphere | Temperature (° C.) | Time (min) | Hydrofluoric Acid Pickling | (%) |
| 1 | 89% | Yes | Yes | Yes | Vacuum | 670 | 240 | — | — |
| 2 | | Yes | | Yes | Vacuum | 670 | 240 | — | — |
| 3 | | Yes | | Yes | Vacuum | 670 | 240 | — | — |
| 4 | | Yes | | Yes | Vacuum | 670 | 240 | — | — |
| 5 | | — | | Yes | Vacuum | 670 | 240 | — | 0.05% |
| 6 | | — | | Yes | Vacuum | 670 | 240 | — | 0.15% |
| 7 | | Yes | | Yes | Ar | 750 | 10 | — | — |
| 8 | | — | | — | Vacuum | 670 | 240 | Yes | 0.15% |
| 9 | | — | | — | Ar | 750 | 10 | Yes | 0.15% |
| 10 | | — | | — | Atmospheric Air | 750 | 10 | Yes | 0.15% |
| 11 | | Yes | | Yes | Vacuum | 670 | 240 | Yes | 0.15% |
| 12 | | Yes | | Yes | Ar | 750 | 10 | Yes | 0.15% |
| 13 | | Yes | | Yes | Atmospheric Air | 750 | 10 | Yes | 0.15% |
| 14 | | Yes | | — | Vacuum | 670 | 240 | — | — |
| 15 | | Yes | | — | Vacuum | 670 | 240 | — | — |
| 16 | | Yes | | — | Vacuum | 670 | 240 | — | — |
| 17 | | — | | — | Vacuum | 670 | 240 | Yes | — |
| 18 | | — | | — | Vacuum | 670 | 240 | Yes | — |

TABLE 1-continued

| | | | | | | | |
|---|---|---|---|---|---|---|---|
| 19 | — | — | Vacuum | 670 | 240 | Yes | — |
| 20 | — | Yes | Vacuum | 670 | 240 | — | — |
| 21 | — | Yes | Vacuum | 670 | 240 | — | — |
| 22 | Yes | — | Vacuum | 670 | 240 | Yes | 0.05% |
| 23 | Yes | — | Vacuum | 670 | 240 | Yes | 0.05% |
| 24 | — | Yes | Ar | 750 | 10 | — | — |
| 25 | — | — | Atmospheric Air | 750 | 10 | Yes | — |

| No. | Scarfing Amount for One Side (μm) | Surface Hardness $HV_{0.015}$ | Surface Roughness Ra (μm) | Surface Roughness Rz (μm) | Surface Roughness Rsm (μm) | High-Lubrication Erichsen Test Value (mm) | Remarks |
|---|---|---|---|---|---|---|---|
| 1 | 1.8 | 149 | 0.13 | 1.05 | 50 | 14.5 | Example |
| 2 | 8.4 | 147 | 0.11 | 1.40 | 71 | 14.6 | Embodiment |
| 3 | 14.9 | 136 | 0.13 | 0.94 | 60 | 14.6 | of Present |
| 4 | 15.1 | 145 | 0.12 | 1.10 | 73 | 14.4 | Invention |
| 5 | 11.8 | 149 | 0.11 | 1.06 | 69 | 14.5 | |
| 6 | 12.9 | 148 | 0.11 | 1.01 | 78 | 14.5 | |
| 7 | 1.8 | 143 | 0.12 | 1.06 | 52 | 14.5 | |
| 8 | 20.5 | 146 | 0.15 | 1.20 | 76 | 14.3 | |
| 9 | 5.4 | 143 | 0.15 | 1.24 | 77 | 14.4 | |
| 10 | 15.6 | 145 | 0.16 | 1.15 | 79 | 14.4 | |
| 11 | 20.5 | 146 | 0.15 | 1.20 | 76 | 14.3 | |
| 12 | 5.4 | 143 | 0.15 | 1.24 | 77 | 14.4 | |
| 13 | 15.6 | 145 | 0.16 | 1.15 | 79 | 14.4 | |
| 14 | 0 | 255* | 0.11 | 1.07 | 80 | 13.8 | Comparative |
| 15 | 0 | 245* | 0.12 | 1.35 | 258* | 13.2 | Example |
| 16 | 0 | 202* | 0.10 | 0.83 | 208* | 13.9 | |
| 17 | 11.3 | 148 | 0.12 | 1.78* | 258* | 13.7 | |
| 18 | 14.5 | 140 | 0.24 | 1.42 | 145* | 14.2 | |
| 19 | 14.3 | 146 | 0.25 | 1.65* | 70 | 14.2 | |
| 20 | 14.7 | 136 | 0.21 | 1.63* | 135* | 14.1 | |
| 21 | 8.8 | 143 | 0.18 | 1.84* | 135* | 14.0 | |
| 22 | 20.5 | 145 | 0.18 | 1.58* | 116* | 13.9 | |
| 23 | 5.6 | 155* | 0.15 | 1.49 | 100* | 14.0 | |
| 24 | 15.6 | 143 | 0.22 | 1.84* | 141* | 13.8 | |
| 25 | 15.6 | 140 | 0.26 | 1.55* | 163* | 14.1 | |

As illustrated in FIGS. 3(*a*) and (*b*), in No. 1 and No. 3 as example embodiments of the present invention, minute irregularities were formed regardless of whether the amount of scarfing was large or small. On the other hand, as illustrated in FIG. 3(*c*), in No. 15 which was subjected to cold rolling using a work roll for which RSm was 80 μm or less and Rz was less than 1.5 μm but which was not subjected to pickling, a large number of minute cracks that arose during cold rolling were present. Further, as illustrated in FIG. 3(*d*), in No. 22 for which pickling was performed after vacuum annealing, but for which a work roll for which RSm was 80 μm or less and Rz was less than 1.5 μm was not used in the temper rolling process, irregularities with large grain units were formed.

As shown in Table 1, in each of Nos. 1 to 13 that are example embodiments of the present invention, the surface hardness Hv was controlled to 150 or less, and the surface roughness Rz was less than 1.5 μm and RSm was 80 μm or less. The reason for this is that in the cold rolling process and/or temper rolling process, appropriate rolling using a "work roll having an RSm of 80 μm or less and an Rz of less than 1.5 μm" was performed, and appropriate surface roughness could be secured. Further, in Nos. 1 to 6 and 11 to 13, because appropriate nitric-hydrofluoric acid pickling was performed prior to performing vacuum annealing (batch type), and TiC and carbon derived from residual oil could be removed, a hardened layer was not formed. In Nos. 8 to 10, because appropriate nitric-hydrofluoric acid pickling was performed after annealing, a hardened layer could be adequately removed. Note that, as shown in No. 9, in the case of annealing (continuous annealing) for which the annealing time was short, because a hardened layer formed on the surface was thin, the hardened layer could be adequately removed even if the amount of scarfing produced by nitric-hydrofluoric acid pickling was small.

On the other hand, in Nos. 14 to 16, nitric-hydrofluoric acid pickling was not performed, and it is considered that for these specimens, carbon components derived from rolling oil from the time of cold rolling remained on the surface or that rolling oil was scored due to a heavy load during rolling and consequently TiC formed on the surface, and such carbon diffused inwardly during vacuum annealing and a hardened layer was formed. As a result, the high-lubrication Erichsen test values stayed at low values.

In Nos. 17 to 21, 24 and 25, although a hardened layer could be adequately removed since an appropriate nitric-hydrofluoric acid pickling was performed before annealing or after annealing, because rolling using a "work roll having an RSm of 80 μm or less and an Rz of less than 1.5 μm" was not performed in either a cold rolling process or a temper rolling process, the surface roughness was outside the range defined by the present invention, and the high-lubrication Erichsen test values stayed at low values.

For Nos. 22 and 23, although a cold rolling process and a pickling process were performed under appropriate conditions, rolling using a "work roll having an RSm of 80 μm or less and an Rz of less than 1.5 μm" was not performed in a temper rolling process, and therefore the surface roughness was outside the range defined by the present invention. In particular, in No. 23, although a pickling process was performed after vacuum annealing (batch type), the amount of scarfing was insufficient and the surface hardness was a high value. Consequently, in these examples, the high-lubrication Erichsen test values stayed at low values.

Note that, in the examples in which the surface hardness was higher than the range defined by the present invention, it is considered that the high-lubrication Erichsen test values stayed at low values because the surface deformability was inferior, minute cracks easily arose in the surface during forming, and the formability deteriorated. Further, in the examples in which the surface roughness was outside the range defined by the present invention, it is considered that irregularities with large grain units were present at the surface, and it became easy for cracks to occur.

Figure 4:
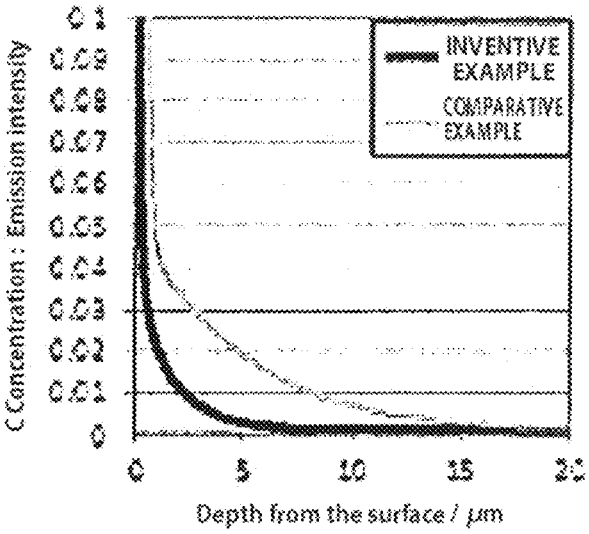
FIG. 4 is a view showing elementary analysis results for Test Nos. 1 and 4.

With regard to Test No. 1 (example embodiment of the present invention) and Test No. 15 (comparative example), an elementary analysis was performed in the depth direction from the titanium plate surface using GDS (glow discharge optical emission spectroscopy). The emission intensity at such time is illustrated in FIG. 4. As illustrated in FIG. 4, it is found that in the example embodiment of the present invention there was almost no concentration of C in the outer layer. Further, when a carbon concentration Cs at a depth of 5 μm from the surface and a carbon concentration Cb at a depth of 20 μm from the surface were calculated by conversion from the emission intensity to determine Cs/Cb, for Test No. 1 the value of Cs/Cb was 1.4, and for Test No. 15 the value of Cs/Cb was 4.9. Thus, it was found that by performing pickling prior to annealing, concentration of C in the outer layer can be prevented.

INDUSTRIAL APPLICABILITY

According to the present invention, since a surface profile that is a cause of the notch effect can be improved and the formation of a brittle hardened layer at an outer layer can be suppressed, a titanium plate having good surface deformability can be provided. Since the titanium plate is excellent in formability, the titanium plate is particularly useful as, for example, a starting material for a heat exchanger at a chemical plant, a power plant, a food processing plant or the like.

The invention claimed is:

1. A titanium plate, wherein:

a Vickers hardness $Hv_{0.025}$ at a load of 0.245 N at a surface is 150 or less, and an average length of profile elements RSm is 10 μm or more, 80 μm or less and Rz is less than 1.5 μm, RSm and Rz being as defined in JIS B 0601: 2013.

2. The titanium plate according to claim 1, wherein:

when a carbon concentration at a depth of 5 μm from the surface is represented by "Cs", and a carbon concentration at a depth of 20 μm from the surface is represented by "Cb", Cs/Cb is in a range of values less than 2.0.

* * * * *